US009450299B2

(12) United States Patent
Ridgeway

(10) Patent No.: US 9,450,299 B2
(45) Date of Patent: Sep. 20, 2016

(54) RESONANT EMBEDDED ANTENNA

(71) Applicant: Digi International Inc., Minnetonka, MN (US)

(72) Inventor: Robert Wayne Ridgeway, Doonan (AU)

(73) Assignee: Digi International Inc., Minnetonka, MN (US)

( * ) Notice: Subject to any disclaimer, the term of this patent is extended or adjusted under 35 U.S.C. 154(b) by 796 days.

(21) Appl. No.: 13/733,469

(22) Filed: Jan. 3, 2013

(65) Prior Publication Data

US 2014/0184448 A1 Jul. 3, 2014

(51) Int. Cl.

| | |
|---|---|
| ***H01Q 1/24*** | (2006.01) |
| ***H01Q 1/38*** | (2006.01) |
| ***H01Q 9/28*** | (2006.01) |
| ***H01Q 5/371*** | (2015.01) |

(52) U.S. Cl.

CPC ..... *H01Q 1/38* (2013.01); *H01Q 5/371* (2015.01); *H01Q 9/285* (2013.01); *Y10T 29/49016* (2015.01)

(58) Field of Classification Search

CPC ..... H01Q 1/38; H01Q 9/0407; H01Q 13/206
USPC ..... 343/700 MS, 702, 878
See application file for complete search history.

(56) References Cited

U.S. PATENT DOCUMENTS

| | | | | |
|---|---|---|---|---|
| 2005/0190108 | A1* | 9/2005 | Lin | H01Q 9/42 343/702 |
| 2011/0309993 | A1* | 12/2011 | He | H01Q 1/38 343/860 |
| 2012/0001803 | A1* | 1/2012 | Shau | H01Q 1/243 343/700 MS |
| 2012/0019415 | A1* | 1/2012 | Tseng | H01Q 1/243 343/700 MS |

* cited by examiner

*Primary Examiner* — Dameon E Levi
*Assistant Examiner* — Collin Dawkins
(74) *Attorney, Agent, or Firm* — Fogg & Powers LLC

(57) ABSTRACT

A planar antenna, such as included as a portion of a printed circuit board assembly, can include a first conductive layer comprising a feed conductor and a patch. The planar antenna can include a second conductive layer comprising a reference conductor, a first arm defined by a first arm length and a first arm width, and a second arm located parallel to the first arm and defined by a second arm length and a second arm width. The first and second arms can be respectively coupled to the reference conductor, and at least a portion of the first arm and at least a portion of the second arm can overlap with a footprint of the patch projected vertically from a plane of the first conductive layer onto a plane of the second conductive layer.

18 Claims, 5 Drawing Sheets

RESONANT EMBEDDED ANTENNA

BACKGROUND

Information can be wirelessly transferred using electromagnetic waves. Generally, such electromagnetic waves are either transmitted or received using a specified range of frequencies, such as established by a spectrum allocation authority. The spectrum allocation authority is generally responsible for licensing and enforcement related to regulations regarding frequencies of operation or power emission levels for a location where a particular wireless device or assembly will be used or manufactured. For example, in the United States, various ranges of frequencies are allocated for low-power industrial, scientific, or medical use (e.g., an "ISM" band.), such as including a first ISM band in the range of about 902 MHz to 928 MHz, or including a second ISM band in the range of about 2400 MHz to about 2483.5 MHz, or including a third ISM band in the range of about 5725 MHz to about 5825 MHz, among other ranges of frequencies.

Wireless devices or assemblies generally include one or more antennas, and each antenna can be configured for transfer of information at a particular range of frequencies. Such ranges of frequencies can include frequencies used by wireless digital data networking technologies. Such technologies can use, conform to, or otherwise incorporate aspects of one or more of the IEEE 802.11 family of "Wi-Fi" standards, one or more of the IEEE 802.16 family of "WiMax" standards, one or more of the IEEE 802.15 family of personal area network (PAN) standards, or one or more other protocols or standards, such as for providing cellular telephone or data services, fixed or mobile terrestrial radio, satellite communications, or for other applications.

OVERVIEW

A printed circuit board assembly (PCBA), such as including a wireless communication circuit, can include a planar antenna. Such a planar antenna can be formed (e.g., patterned, etched, deposited, stamped, or otherwise fabricated) using a conductive material that can also be used for forming various other electrical or mechanical interconnections of the circuit board. In this manner, the planar antenna can be "embedded" in the PCBA without requiring an additional discrete antenna component, antenna connector, or cabling. The present inventor has recognized, among other things, that such a planar antenna can be cheaper to fabricate or more volumetrically compact as compared to using a separate antenna component that is soldered or otherwise attached to a circuit board.

In an example, a planar antenna, such as included as a portion of a printed circuit board assembly, can include a first conductive layer comprising a feed conductor and a patch. The planar antenna can include a second conductive layer comprising a reference conductor, a first arm defined by a first arm length and a first arm width, and a second arm located parallel to the first arm and defined by a second arm length and a second arm width. The first and second arms can be respectively coupled to the reference conductor, and at least a portion of the first arm and at least a portion of the second arm can overlap with a footprint of the patch projected vertically from a plane of the first conductive layer onto a plane of the second conductive layer.

This overview is intended to provide an overview of subject matter of the present patent application. It is not intended to provide an exclusive or exhaustive explanation of the invention. The detailed description is included to provide further information about the present patent application.

BRIEF DESCRIPTION OF THE DRAWINGS

In the drawings, which are not necessarily drawn to scale, like numerals may describe similar components in different views. Like numerals having different letter suffixes may represent different instances of similar components. The drawings illustrate generally, by way of example, but not by way of limitation, various embodiments discussed in the present document.

DETAILED DESCRIPTION

Figure 1A:
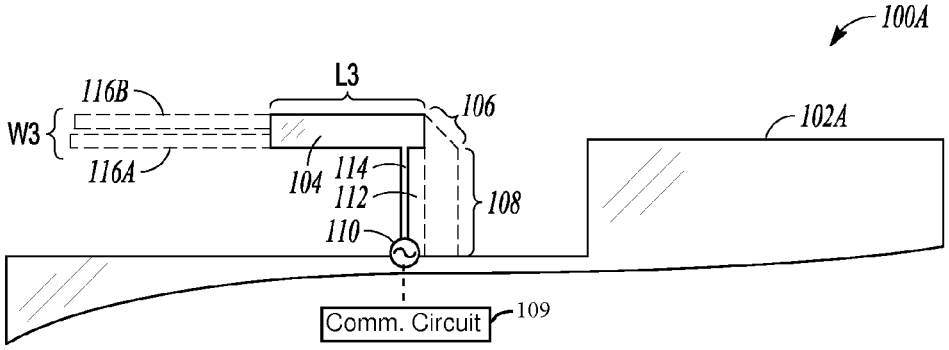
FIG. 1A illustrates generally an example of at least a portion of a planar antenna, such as can include first conductive layer comprising a conductive strip aligned with corresponding conductive strips on a second conductive layer of the planar antenna.
Figure 1B:
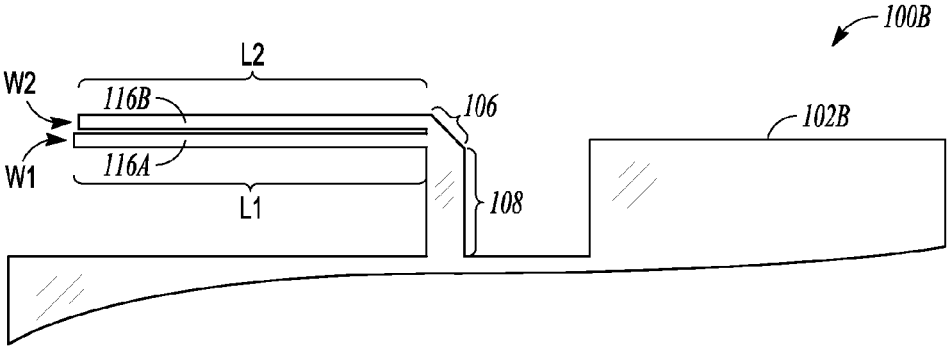
FIG. 1B illustrates generally an example of at least a portion of a planar antenna, such as located vertically offset (e.g., above or below) a plane of the first conductive layer of the example of FIG. 1A.
Figure 1C:
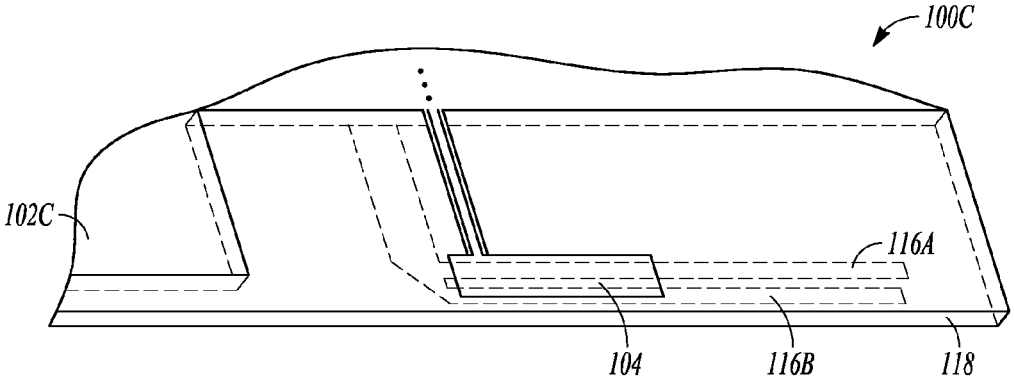
FIG. 1C illustrates generally an example of at least a portion of a planar antenna, such a showing an illustrative example of printed circuit board assembly that can include a first conductive layer, a second conductive layer, and a dielectric substrate.

FIG. 1A illustrates generally an example of at least a portion of a planar antenna, such as can include first conductive layer 100A comprising a conductive strip 104 aligned with corresponding conductive strips on a second conductive layer of the planar antenna. FIG. 1B illustrates generally an example of at least a portion of a planar antenna, such as can include a second conductive layer 100B, located vertically offset (e.g., above or below) a plane of the first conductive layer 100A of the example of FIG. 1A. FIG. 1C illustrates generally an example of at least a portion of a planar antenna, such a showing an illustrative example of printed circuit board assembly (PCBA) 100C that can include a first conductive layer (e.g., as shown in FIG. 1A), a second conductive layer (e.g., as shown in FIG. 1B), and a dielectric substrate 118.

In an example, the planar antenna of FIGS. 1A through 1C can be driven using a feed conductor 114, such as using a matching structure or other circuitry included as a portion of the PCBA 100C. For example, an output of a communication circuit 109 can be coupled to a port 110 to provide a communication signal to the feed conductor 114, such as a "single ended" output signal coupled between the feed conductor 114 and a reference node (e.g., a "ground" node). The reference node can include a first reference plane 102A included as a portion of the first conductive layer 100A or a second reference plane 102B included as a portion of the second conductive layer 100B.

In the example of FIGS. 1A through 1C, the planar antenna can include a patch 104, such as included as a portion of the first conductive layer 100A. The patch 104 can be conductively coupled to the feed conductor 114, and the patch can be defined by a patch length L3 and a patch width W3. The patch 104 can be aligned with one or more features or portions of one or more other conductive layers.

The second conductive layer 100B can include a first arm 116A and a second arm 116B, such as laterally offset from the first arm 116A by a specified distance. For example, as shown in FIGS. 1A through 1C, the patch 104 can overlap with at least a portion of the first and second arms 116A and 116B. The patch 104 can include a long axis aligned in parallel with the first and second arms 116A and 116B. The specified distance between the first and second arms can be adjusted or determined, such as to provide a width W3, between the outer edges of the first and second arms 116A and 116B, that is about the same as the patch 104 width. The first arm 116A can be defined by a first arm length L1, and a first arm width W1, and the second arm 116B can be defined by a second arm length L2, and a second arm width W2.

The present inventor has recognized, among other things, that a usable range of operating frequencies can be broadened or otherwise specified, such as by including a first arm length L1 that is different than the second arm length L2. A resonance established at least in part using the first arm length L1 can be offset from a resonance established at least in part using the second arm length L2. In another example, the respective arm lengths L1 and L2 can be used to establish respective operating frequency ranges that can be offset from each other. The first and second arms 116A and 116B can be coupled to a reference conductor 108, such as using a beveled transition 106. The reference conductor 108 can be coupled to a second reference plane 102B. The second reference plane 102B can be coupled to a reference node (e.g., a "ground" node), or coupled to the first reference plane 102A on the first conductive layer 100A. For example, "stitching" vias can couple the first reference plane 102A to the second reference plane 102B, such as to provide a specified impedance or a reduced impedance between the reference planes 102A and 102B.

A third resonance can be established by one or more of the patch 104, the feed conductor 114, and the reference conductor 108 (e.g., providing a resonant "coupler" configuration that can both radiate and couple energy for radiation by the first and second arms 116A and 116B). The feed conductor 114 can define a footprint. The footprint can be projected from the first conductive layer 100A to the second conductive layer 100B. The reference conductor 108 can be located outside the projected footprint of the feed conductor 114, such as separated by a specified lateral offset 112. In this manner, an input impedance of the planar antenna can be controlled, such as to present a specified input impedance (e.g., a specified real impedance or a specified conjugate match to an output impedance of the communication circuit 109). The first, second, or third resonances can be selected to provide a specified input impedance in a specified range of operating frequencies.

For example, one or more of a width of the reference conductor 108, a length of the reference conductor 108, a width of the feed conductor 114, a length of the feed conductor 114, a vertical offset between the reference conductor 108 and the feed conductor 114 (e.g., a lamination thickness or a PCBA 100C board thickness), or a lateral offset 112 between the reference conductor and the feed conductor can be used to establish an input impedance of the planar antenna within a specified range of operating frequencies, at least in part. In an example, such as shown in FIGS. 1A through 1C, the feed conductor 114 can be perpendicular to a long axis of the patch 104, and can be coupled to the patch 104, conductively, at a location offset from a corner of the patch 104, such as to provide the specified lateral offset 112 between the feed conductor 114 on the first conductive layer 100A, and the reference conductor 108 on the second conductive layer 100B. For example, the resonances can be specified to provide specified (e.g., maximum) flatness of a return loss or Voltage Standing Wave Ratio (VSWR), in a specified range of frequencies. Or, such resonances can be specified to provide a specified bandwidth below a specified VSWR, such as extending a usable bandwidth as compared to the maximum flatness example, but with greater variation (e.g., ripple) in VSWR (or, correspondingly, return loss) within the range of usable frequencies.

Other regions of the PCBA 100C can include a return plane (e.g., a copper fill pattern or planar copper portion), such as in a circuitry region included elsewhere on or within the PCBA 100C. Such a plane can provide a counterpoise or pathway for currents to return to the wireless communication circuit 109 included as a portion of the PCBA 100C. In an example, in the region underneath or nearby the planar antenna (e.g., on a surface of the PCBA opposite the antenna conductors), the plane can be "pulled back" so that there is little or no copper in the layer or layers underneath the antenna, such as shown in the illustrative example of FIGS. 1A through 1C. Such a configuration can allow the planar antenna to more effectively radiate or receive energy omnidirectionally, particularly in elevations above or below a "horizon" defined by a plane of the PCBA 100C, as compared to other antenna geometries.

In an example, a dielectric substrate 118 of the PCBA 100C can include a glass-epoxy laminate such as FR-4, FR-406, or one or more other materials, such as generally used for printed circuit board (PCB) fabrication. Such materials can include a bismaleimide-triazine (BT) material, a cyanate ester, a polyimide material, or a polytetrafluoroethylene material, or one or more other materials. One or more of the conductive portions of the PCBA 100C can include electrodeposited or rolled-annealed copper, such as patterned using a photolithographic process, or formed using one or more other techniques (e.g., a deposition, a stamping, etc.)

Figure 2:
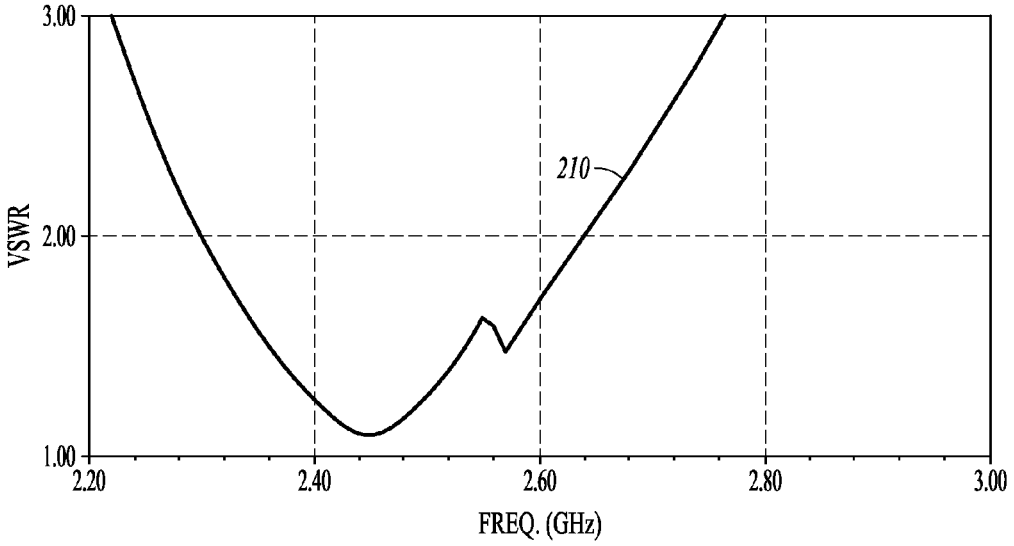
FIG. 2 illustrates generally an illustrative example of a voltage standing wave ratio (VSWR), such as can be simulated for the antenna configuration of FIGS. 1A through 1C.

FIG. 2 illustrates generally an illustrative example of a voltage standing wave ratio 210 (VSWR), such as can be simulated for the planar antenna configuration of FIGS. 1A through 1C. A usable range of operating frequencies can be specified in terms of VSWR, or in terms of a corresponding return loss, or using one or more other criteria. For example, a specified $S_{11}$ parameter of about −10 dB or lower (e.g., a return loss of 10 dB), can be considered generally acceptable for a variety of applications. Such a return loss corresponds to a VSWR of about 2:1 or less. In the illustrative example of FIG. 2, the VSWR 210 is less than 2:1 in a range from less than 2400 MHz (2.4 gigahertz (GHz)) to more than 2600 MHz (2.6 GHz). The simulated performance of the planar antenna of FIGS. 1A through 1C is similar to the experimentally-obtained return loss illustrated in the example of FIG. 3.

Figure 3:
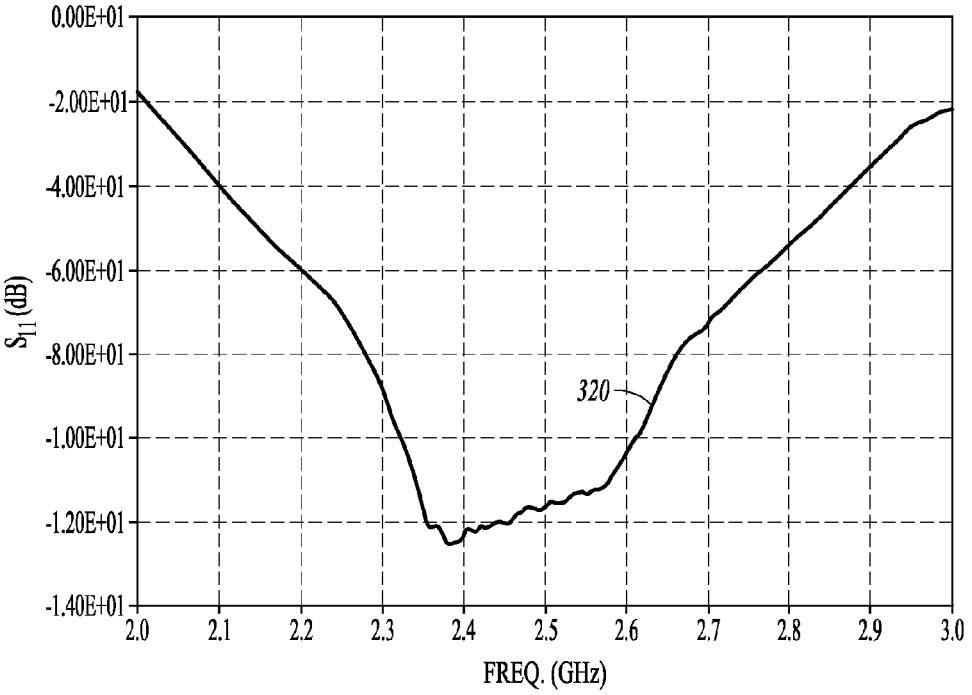
FIG. 3 illustrates generally an illustrative example of a return loss that can be experimentally obtained for the antenna configuration of FIGS. 1A through 1C.

FIG. 3 illustrates generally an illustrative example of a return loss 320 (e.g., an $S_{11}$ parameter) that can be experimentally obtained for the antenna configuration of FIGS. 1A through 1C. In this illustrative example, a multiple resonant response is shown, similar to the simulated voltage standing wave ratio (VSWR) of the example of FIG. 2, such as corresponding to the impedance response shown in the Smith Chart of FIG. 4. In the example of FIG. 3, a usable range of frequencies can include a range from less than 2400 MHz (2.4 gigahertz (GHz)) to more than 2600 MHz (2.6 GHz), such as corresponding to a specified $S_{11}$ parameter of −10 dB or lower (e.g., a return loss of 10 dB, or a voltage standing wave ratio (VSWR) of 2:1 or less), or one or more other values. The experimentally-obtained response shown in FIG. 3 can be obtained such as by tuning a radiating coupler including the feed conductor 114 and the reference conductor 108 to provide a resonance similar to or between one or more respective resonances established by other elements of the planar antenna, such as the first or second conductive arms 116A or 116B.

Figure 4:
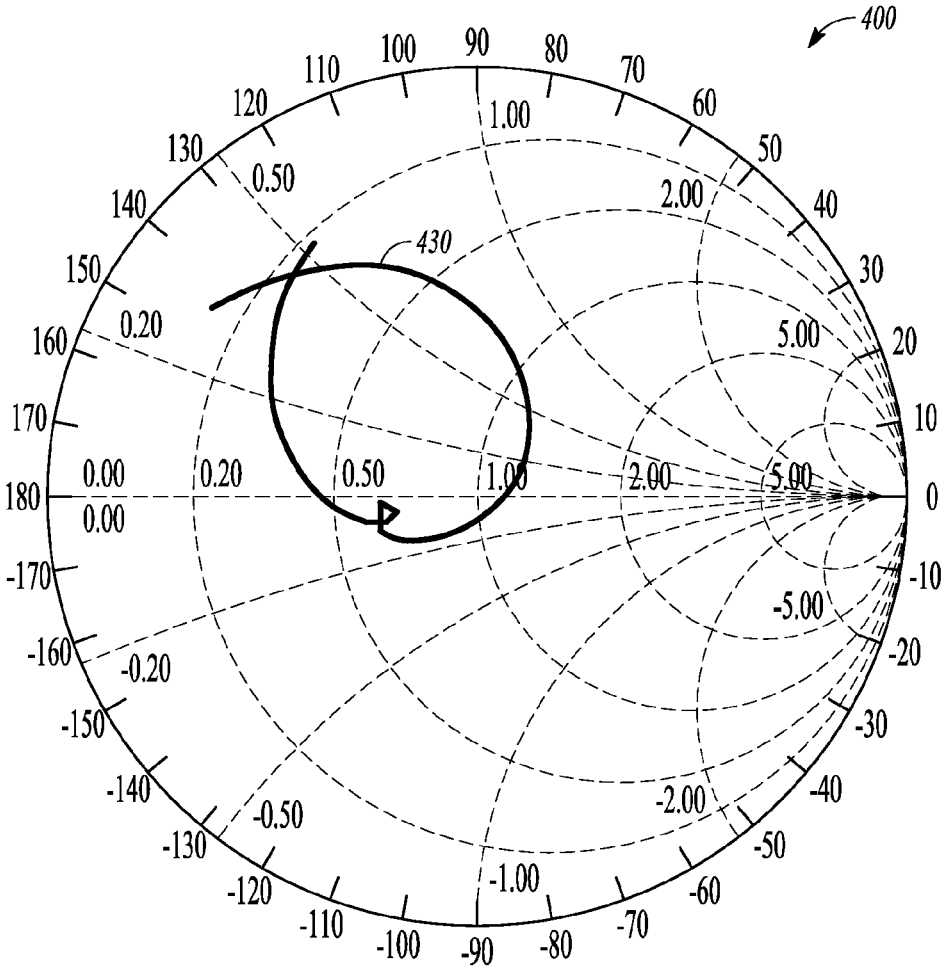
FIG. 4 illustrates generally an illustrative example of an impedance Smith Chart that can be simulated for the antenna configuration of FIGS. 1A through 1C.

FIG. 4 illustrates generally an illustrative example 430 of an impedance Smith Chart that can be simulated for the antenna configuration of FIGS. 1A through 1C. In the example of FIG. 4, loops in the impedance response indicate coupling behavior from the multiple elements (e.g., the patch 104 and the respective first and second conductive arms 116A and 116B, along with the feed conductor 114 and the reference conductor 108). One or more geometric or material parameters of the planar antenna can be varied, such as to shift the locus of loops in the impedance closer to the center or unit impedance (e.g., corresponding to 50 ohms real impedance), or to some other desired input impedance to provide a conjugate impedance match to an output of the wireless communication circuit 109.

Figure 5:
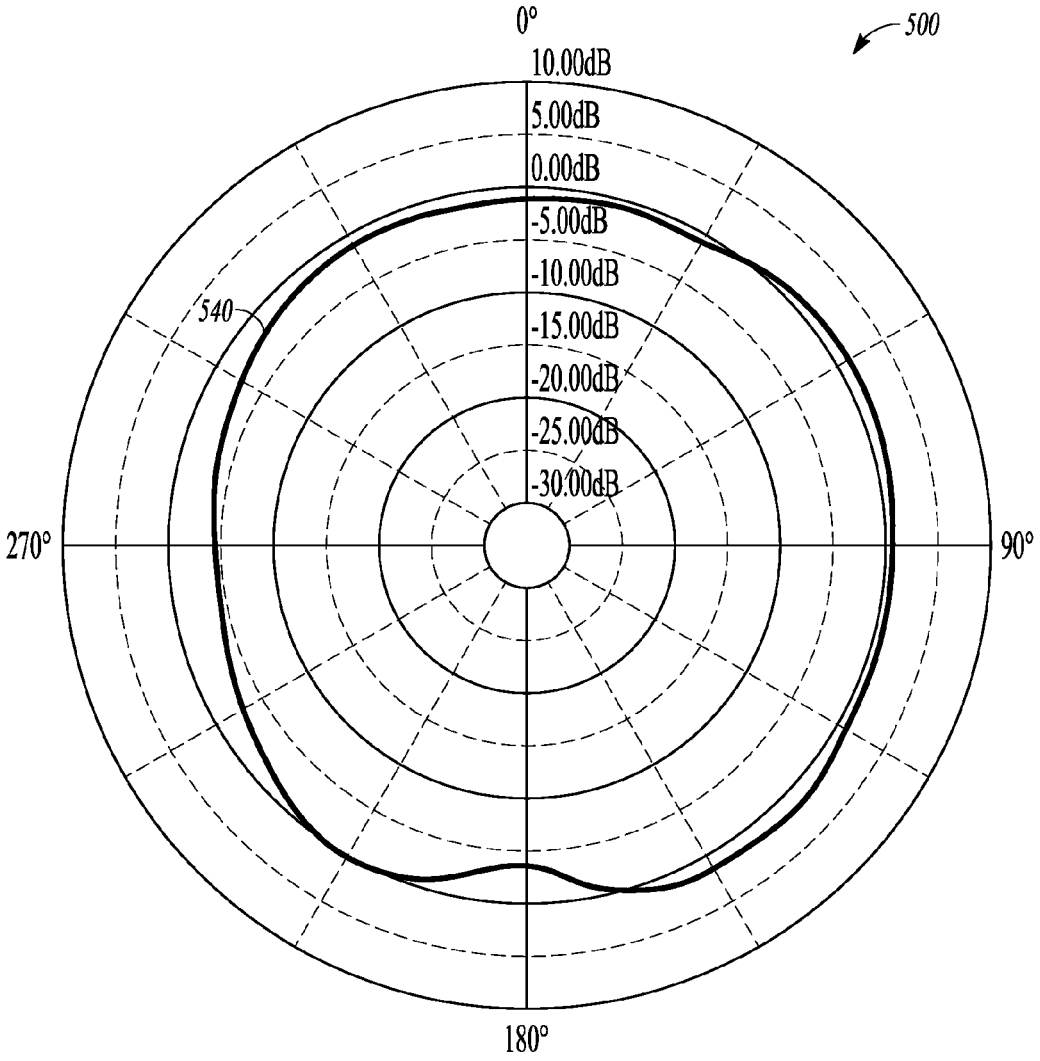
FIG. 5 illustrates generally an illustrative example of a radiation plot showing a peak gain, in decibels, as compared to an isotropic radiator (dBi) in a plane normal to the plane of the configuration of FIGS. 1A through 1C.

FIG. 5 illustrates generally an illustrative example of a radiation plot 540 that can be experimentally obtained, showing a peak gain in decibels as compared to an isotropic radiator (dBi), of the radiation in a plane normal to the plane of the PCBA 100C for the planar antenna configuration of FIGS. 1A through 1C in an operating frequency range spanning from about 2400 megahertz (MHz) to about 2484 MHz. An average gain of about 0.55 dBi is exhibited across all elevations, and a null in the back-facing axis looking back into the PCBA 100C at 270 degrees still provides a radiation component greater than −5 dBi. The zero degree and 180 degree positions represent the radiation components above and below the antenna, respectively, and the range from zero to 180 degrees covers elevations extending above, laterally outward, and below an edge of the PCBA 100C where the planar antenna can be located.

Figure 6:
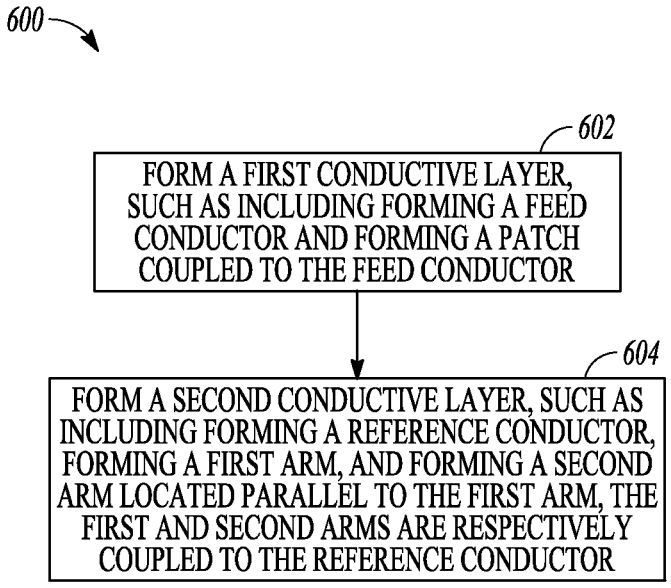
FIG. 6 illustrates generally a technique, such as a method, that can include forming a planar antenna, such as the planar antenna of FIGS. 1A through 1C.

FIG. 6 illustrates generally a technique 600, such as a method, that can include forming a planar antenna, such as the planar antenna of FIGS. 1A through 1C. At 602, a first conductive layer can be formed, such as including forming a feed conductor and forming a patch coupled to the feed conductor. At 604, a second conductive layer can be formed, such as including forming a reference conductor (e.g., a strip-shaped reference conductor), and a forming respective first and second arms. At least a portion of the first and second arms can respectively overlap with a footprint of the patch projected vertically from a plane of the first conductive layer onto a plane of the second conductive layer. Information can be transferred wirelessly using the planar antenna, such as coupling a single-ended wireless communication signal to or from the planar antenna at a port defined by the feed conductor and the reference conductor. For example, such information transfer can be performed in one or more specified operating frequencies, such as around 2400 MHz.

VARIOUS NOTES & EXAMPLES

The above detailed description includes references to the accompanying drawings, which form a part of the detailed description. The drawings show, by way of illustration, specific embodiments in which the invention can be practiced. These embodiments are also referred to herein as "examples." Such examples can include elements in addition to those shown or described. However, the present inventor also contemplates examples in which only those elements shown or described are provided. Moreover, the present inventor also contemplates examples using any combination or permutation of those elements shown or described (or one or more aspects thereof), either with respect to a particular example (or one or more aspects thereof), or with respect to other examples (or one or more aspects thereof) shown or described herein.

In the event of inconsistent usages between this document and any documents so incorporated by reference, the usage in this document controls.

In this document, the terms "a" or "an" are used, as is common in patent documents, to include one or more than one, independent of any other instances or usages of "at least one" or "one or more." In this document, the term "or" is used to refer to a nonexclusive or, such that "A or B" includes "A but not B," "B but not A," and "A and B," unless otherwise indicated. In this document, the terms "including" and "in which" are used as the plain-English equivalents of the respective terms "comprising" and "wherein." Also, in the following claims, the terms "including" and "comprising" are open-ended, that is, a system, device, article, composition, formulation, or process that includes elements in addition to those listed after such a term in a claim are still deemed to fall within the scope of that claim. Moreover, in the following claims, the terms "first," "second," and "third," etc. are used merely as labels, and are not intended to impose numerical requirements on their objects.

Method examples described herein can be machine or computer-implemented at least in part. Some examples can include a computer-readable medium or machine-readable medium encoded with instructions operable to configure an electronic device to perform methods as described in the above examples. An implementation of such methods can include code, such as microcode, assembly language code, a higher-level language code, or the like. Such code can include computer readable instructions for performing various methods. The code may form portions of computer program products. Further, in an example, the code can be tangibly stored on one or more volatile, non-transitory, or non-volatile tangible computer-readable media, such as during execution or at other times. Examples of these tangible computer-readable media can include, but are not limited to, hard disks, removable magnetic disks, removable optical disks (e.g., compact disks and digital video disks), magnetic cassettes, memory cards or sticks, random access memories (RAMs), read only memories (ROMs), and the like.

The above description is intended to be illustrative, and not restrictive. For example, the above-described examples (or one or more aspects thereof) may be used in combination with each other. Other embodiments can be used, such as by one of ordinary skill in the art upon reviewing the above description. The Abstract is provided to comply with 37 C.F.R. §1.72(b), to allow the reader to quickly ascertain the nature of the technical disclosure. It is submitted with the understanding that it will not be used to interpret or limit the scope or meaning of the claims. Also, in the above Detailed Description, various features may be grouped together to streamline the disclosure. This should not be interpreted as intending that an unclaimed disclosed feature is essential to any claim. Rather, inventive subject matter may lie in less than all features of a particular disclosed embodiment. Thus, the following claims are hereby incorporated into the Detailed Description as examples or embodiments, with each claim standing on its own as a separate embodiment, and it is contemplated that such embodiments can be combined with each other in various combinations or permutations. The scope of the invention should be determined with reference to the appended claims, along with the full scope of equivalents to which such claims are entitled.

The claimed invention is:

1. A planar antenna, comprising:

a first conductive layer including:

a feed conductor having a strip shape defining a long axis and a short axis; and a patch coupled to the feed conductor, the patch defined by a patch length and a patch width; and a second conductive layer including:

a reference conductor including a strip portion having a strip shape defining a long axis and a short axis, wherein a long axis of the reference conductor is parallel with a long axis of the feed conductor;

a first arm defined by a first arm length and a first arm width; and a second arm located parallel to the first arm and defined by a second arm length and a second arm width;

wherein the first arm is coupled to the strip portion of the reference conductor via a beveled transition portion and the second arm is coupled to the strip portion of the reference conductor via the beveled transition portion; and wherein at least a portion of the first arm and at least a portion of the second arm overlap with a footprint of the patch projected vertically from a plane of the first conductive layer onto a plane of the second conductive layer; wherein the planar antenna is coupleable to a wireless communication circuit using a port established by the feed conductor and the reference conductor, wherein a usable range of operating frequencies is broadened, and wherein one of: a vertical offset between the reference conductor and the feed conductor; or a lateral offset between the reference conductor and the feed conductor is used to establish an input impedance of the planar antenna within a specified range of the operating frequencies, at least in part.

2. The planar antenna of claim 1, wherein the first and second arm widths are respectively narrower than the patch width.

3. The planar antenna of claim 1, wherein the reference conductor is located outside a footprint of the feed conductor projected vertically from the plane of the first conductive layer onto the plane of the second conductive layer.

4. The planar antenna of claim 3, wherein the input impedance of the planar antenna within the specified range of the operating frequencies is further established, at least in part, by one or more of a width of the reference conductor, a length of the reference conductor, a width of the feed conductor, and a length of the feed conductor is used to establish.

5. The planar antenna of claim 1, wherein a long axis of the patch is parallel to respective long axes of the first and second arms.

6. The planar antenna of claim 1, wherein a long axis of the patch is perpendicular to a long axis of the feed conductor, in a plane of the first conductive layer.

7. The planar antenna of claim 1, wherein the feed conductor is coupled to the patch at a location offset from a corner of the patch.

8. The planar antenna of claim 1, wherein the first arm is coupled to the beveled transition portion and the second arm is coupled to the beveled transition portion at or nearby respective edges of the respective first and second arms.

9. The planar antenna of claim 1, wherein the strip portion of the reference conductor is wider than the respective widths of the first and second arms.

10. The planar antenna of claim 1, wherein the first and second arms have the same width.

11. The planar antenna of claim 1, wherein the reference conductor is connected to a first reference plane.

12. The planar antenna of claim 11, wherein the first conductive layer comprises a second reference plane coupled to the first reference plane.

13. The planar antenna of claim 1, comprising a dielectric substrate; and wherein the first and second conductive layers are mechanically coupled to the dielectric substrate.

14. A system, comprising:

a dielectric substrate;

a first conductive layer including:

a feed conductor; and a patch coupled to the feed conductor, the patch defined by a patch length and a patch width; and a second conductive layer including:

a reference conductor comprising a strip portion, the strip portion including a long axis parallel to a long axis of the feed conductor;

a first arm defined by a first arm length and a first arm width; and a second arm located parallel to the first arm and defined by a second arm length and a second arm width;

wherein the first arm is coupled to the strip portion of the reference conductor via a beveled transition portion and the second arm is coupled to the strip portion of the reference conductor via the beveled transition portion;

wherein a long axis of the patch is parallel to respective long axes of the first and second arms;

wherein at least a portion of the first arm and at least a portion of the second arm overlap with a footprint of the patch projected vertically from a plane of the first conductive layer onto a plane of the second conductive layer;

wherein the planar antenna is coupleable to a wireless communication using a port established by the feed conductor and the reference conductor, wherein a usable range of operating frequencies is broadened, and wherein one of: a vertical offset between the reference conductor and the feed conductor; or a lateral offset between the reference conductor and the feed conductor is used to establish an input impedance of the planar antenna within a specified range of the operating frequencies, at least in part.

15. A method for forming a planar antenna, comprising:

forming a first conductive layer, including:

forming a feed conductor having a strip shape defining a long axis and a short axis; and forming a patch coupled to the feed conductor, the patch defined by a patch length and a patch width; and forming a second conductive layer including:

forming a reference conductor including a strip portion having a strip shape defining a long axis and a short axis, wherein a long axis of the reference conductor is parallel with a long axis of the feed conductor;

forming a first arm defined by a first arm length and a first arm width; and forming a second arm located parallel to the first arm and defined by a second arm length and a second arm width;

establishing, at least in part, an input impedance of the planar antenna within a specified range of operating frequencies using one of: a vertical offset between the reference conductor and the feed conductor; or a lateral offset between the reference conductor and the feed conductor, wherein the first arm is coupled to the strip portion of the reference conductor via a beveled transition portion and the second arm is coupled to the strip portion of the reference conductor via the beveled transition portion; and wherein at least a portion of the first arm and at least a portion of the second arm overlap with a footprint of the patch projected vertically from a plane of the first conductive layer onto a plane of the second conductive layer, and wherein a usable range of the operating frequencies is broadened.

16. The method of claim 15, wherein the reference conductor is formed outside a footprint of the feed conductor projected vertically from the plane of the first conductive layer onto the plane of the second conductive layer.

17. The method of claim 15, wherein establishing, at least in part, the input impedance of the planar antenna within the specified range of the operating frequencies further comprises:

establishing the input impedance of the planar antenna within the specified range of the operating frequencies using one or more of a width of the reference conductor, a length of the reference conductor, a width of the feed conductor, and a length of the feed conductor.

18. The method of claim 15, comprising forming a dielectric substrate;

wherein the first and second conductive layers are mechanically coupled to the dielectric substrate.

* * * * *